US008672285B1

(12) United States Patent
Romero

(10) Patent No.: US 8,672,285 B1
(45) Date of Patent: Mar. 18, 2014

(54) DOCUMENT HOLDER

(76) Inventor: Maria B. Romero, Crystal Lake, IL (US)

( * ) Notice: Subject to any disclaimer, the term of this patent is extended or adjusted under 35 U.S.C. 154(b) by 218 days.

(21) Appl. No.: 13/135,283

(22) Filed: Jun. 30, 2011

(51) Int. Cl.
*B41J 11/02* (2006.01)

(52) U.S. Cl.
USPC ..... 248/442.2; 248/447; 248/447.1; 248/452; 248/918; 361/679.25

(58) Field of Classification Search
USPC ..... 248/441.1, 442.2, 447, 447.1, 452, 918; 361/679.25
See application file for complete search history.

(56) References Cited

U.S. PATENT DOCUMENTS

| | | | | | |
|---|---|---|---|---|---|
| 1,685,041 | A | * | 9/1928 | Binkele | 248/442.2 |
| 4,619,429 | A | * | 10/1986 | Mazza | 248/447.2 |
| 5,074,512 | A | | 12/1991 | Gianforcaro, II et al. | |
| 5,078,358 | A | * | 1/1992 | Egly et al. | 248/447.1 |
| 5,292,099 | A | * | 3/1994 | Isham et al. | 248/442.2 |
| 5,383,642 | A | * | 1/1995 | Strassberg | 248/442.2 |
| 5,385,327 | A | * | 1/1995 | Hegarty et al. | 248/442.2 |
| 5,467,958 | A | | 11/1995 | Selvaggio | |
| 5,499,793 | A | | 3/1996 | Salansky | |
| 5,618,020 | A | * | 4/1997 | Hegarty et al. | 248/442.2 |
| 5,651,524 | A | | 7/1997 | Calfee | |
| 5,732,924 | A | * | 3/1998 | Hegarty et al. | 248/442.2 |
| 5,769,378 | A | * | 6/1998 | Correa | 248/442.2 |
| 5,901,937 | A | * | 5/1999 | Compeau et al. | 248/442.2 |
| 5,975,478 | A | * | 11/1999 | Marino | 248/442.2 |
| 6,024,337 | A | * | 2/2000 | Correa | 248/442.2 |
| 6,173,936 | B1 | * | 1/2001 | Hegarty | 248/442.2 |
| 6,290,200 | B1 | * | 9/2001 | Ko | 248/442.2 |
| 7,256,986 | B2 | | 8/2007 | Williams et al. | |
| 7,611,117 | B1 | | 11/2009 | Lang, Jr. | |
| 7,681,856 | B1 | * | 3/2010 | Thomas et al. | 248/442.2 |
| 2002/0066846 | A1 | * | 6/2002 | Giulie et al. | 248/442.2 |
| 2005/0001135 | A1 | * | 1/2005 | Bauman et al. | 248/444.1 |

* cited by examiner

*Primary Examiner* — Bradley Duckworth
(74) *Attorney, Agent, or Firm* — Brie A. Crawford

(57) ABSTRACT

A document holder for a computer holds multiple documents at a single time and provides easy visual access for up to three documents concurrently. The document holder attaches to a computer and has a full extension position during the time the document holder is in use. Also, the document holder has a stored position which allows it to be compactly stored on the computer when not in use. The stored position allows the document holder to remain attached to, but not interfere with, the use of the computer. The document holder has mount clamps which provide easy attachment and removal to and from the computer.

7 Claims, 9 Drawing Sheets

DOCUMENT HOLDER

This invention relates to a document holder and more particularly to a document holder which attaches to a desktop or laptop computer and provides easy visual access simultaneously to multiple documents.

BACKGROUND OF THE INVENTION

In today's world, computers are necessary, if not essential, for both business and home matters. Both laptop computers and desktop computers are used to conduct business, manage household affairs, complete educational assignments, and provide entertainment.

When using a laptop or desktop computer, it is many times necessary to have easy access to a variety of documents. The documents may be placed on the desk or table but this requires the user to look down to view the information on the documents. A document holder which can provide easier visual access to documents is a useful invention.

Also, many times it is necessary to access a number of documents while working on a desktop or laptop computer. If the documents are stacked in piles on a table or desk, it requires the user to stop working and move pages around to access multiple documents. This can be very time consuming and frustrating for the user. A document holder which can provide easy access to multiple documents without the need to stop work is a useful invention.

Moreover, when multiple documents are being utilized, organizing them in a usable fashion becomes a challenge. A user may have to search through a pile of papers to find the necessary document. This challenge can also be time consuming and frustrating for the user. A document holder which can organize large numbers of documents is a useful invention.

While the document holder must be able to present and organize a large amount of documents, it also must be compact and easily stored. The document holder cannot interfere with the use of the desktop or laptop computer when it is stored. A document holder which can be easily stored is a useful invention.

SUMMARY OF THE INVENTION

Among the many objectives of the present invention is the provision of a document holder which provides easy visual access to multiple documents at a time.

Yet another objective of the present invention is the provision of a document holder which does not require a user to look down, away from the computer, to read the document.

A further objective of the present invention is the provision of a document holder which can organize a large number of documents at a time.

Moreover, another objective of the present invention is the provision of a document holder which securely holds the documents in place.

A still further objective of the present invention is the provision of a document holder which folds down into a compact storage position when not in use and does not interfere with the use of the computer.

Also, an objective of the present invention is the provision of a document holder which allows documents to be readily removed and reorganized.

Another objective of the present invention is the provision of a document holder which can be attached to a computer without the need for adhesives or glue.

Moreover, an objective of the present invention is the provision of a document holder which can be easily attached to and removed from a computer.

These and other objectives of the invention (which other objectives become clear by consideration of the specification, claims and drawings as a whole) are met by providing a document holder for a desktop or laptop computer which allows easy visual access to multiple documents, organizes a large amount of pages, yet is compact and easily stored.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
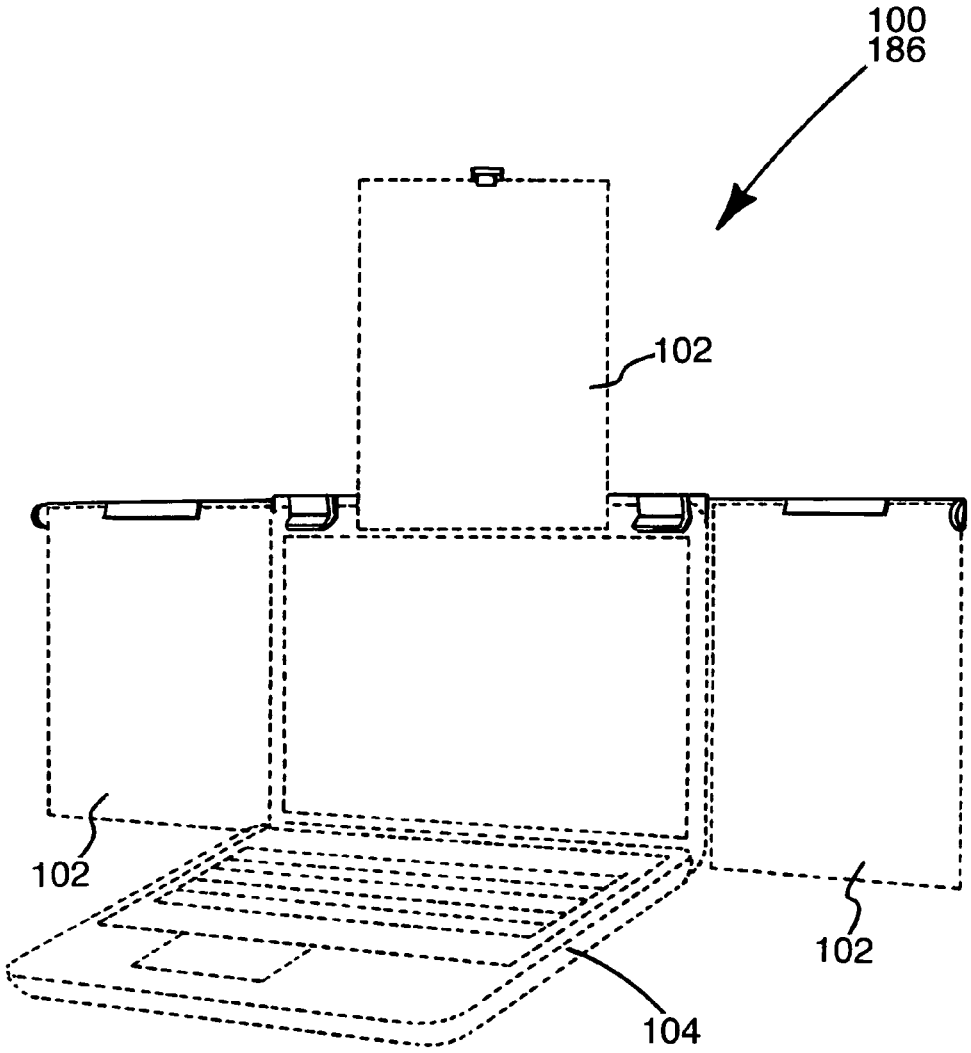
FIG. 1 depicts a front perspective view of document holder 100 in full extension 186 holding three documents 102, which are depicted in phantom, mounted on computer 104 which is depicted in phantom.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, over, above, below, beneath, rear, and front, may be used with respect to the drawings. These and similar to directional terms are not to be construed to limit the scope of the invention in any manner. The words attach, connect, couple, and similar terms with their inflectional morphemes do not necessarily denote direct or intermediate connections, but may also include connections through mediate elements or devices.

A document holder is mounted to either a desktop or laptop computer. The document holder allows a user to read and organize multiple documents and places the documents in the user's visual range while using the computer. The document holder may be fully extended and has three arms. Each of the three arms is capable of holding multiple documents in a secure and flat plane position. The document holder can hold up to 30 or more documents at a single time. When the document holder is not in use it folds compactly into a stored position and does not interfere with the use of the computer. The document holder opens and closes in a telescopic fashion.

A significant advantage of the document holder is that it can be attached to the computer without the need for adhesives or glue. This is very beneficial because the document holder can be attached to or removed from the computer with ease. The attachment and removal process does not harm the computer in any fashion which provides great advantages to attachment using adhesives or glue.

The terms document and documents are used interchangeably throughout this application. Each arm of the document holder may hold a single document or multiple documents depending on the user preference.

Now adding FIG. 1 to the consideration the structure and function of document holder 100 can be clearly seen. In this view, document holder 100 is holding three documents 102 on computer 104. Document holder 100 is in full extension 186 so that three documents 102 can be viewed at once. However, document holder 100 can hold more than three documents 102. Document holder 100 can hold 100 or more documents at a single time.

Figure 2:
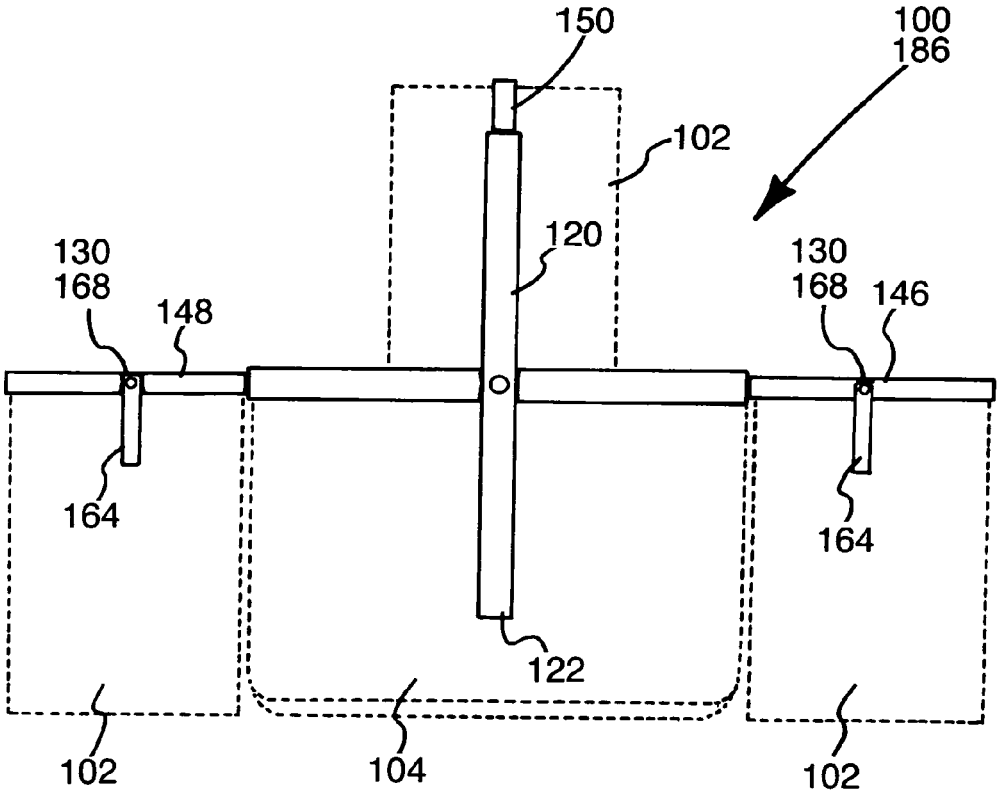
FIG. 2 depicts a rear view of document holder 100 showing sheet support 164 and center channel 120 with documents 102 and computer 104 shown in phantom.

Now adding FIG. 2 to the consideration, further features of document holder 100 can be clearly seen. In this view, document holder 100 is in full extension 186. Right arm 148 is connected to computer 104 and holding document 102. Sheet support 164 supports one or multiple documents 102 and aids in keeping documents 102 in a flat plane and stable position. Left arm 146 functions similarly to right arm 148. Left arm 146 is connected to computer 104 and is holding documents 102 in place with the help of sheet support 164. Center arm 150 functions similarly to right arm 148 and left arm 146 and is connected to computer 104. Center arm 150 is holding documents 102 in place.

Center arm 150 extends out from center channel 120 and holds document 102 in a flat plane and stable position. Center channel 120 also adds support to center arm 150. Center channel 120 contains center stabilizer end 122 which supports the entire document holder 100 as it rests against the back of computer 104.

Figure 3:
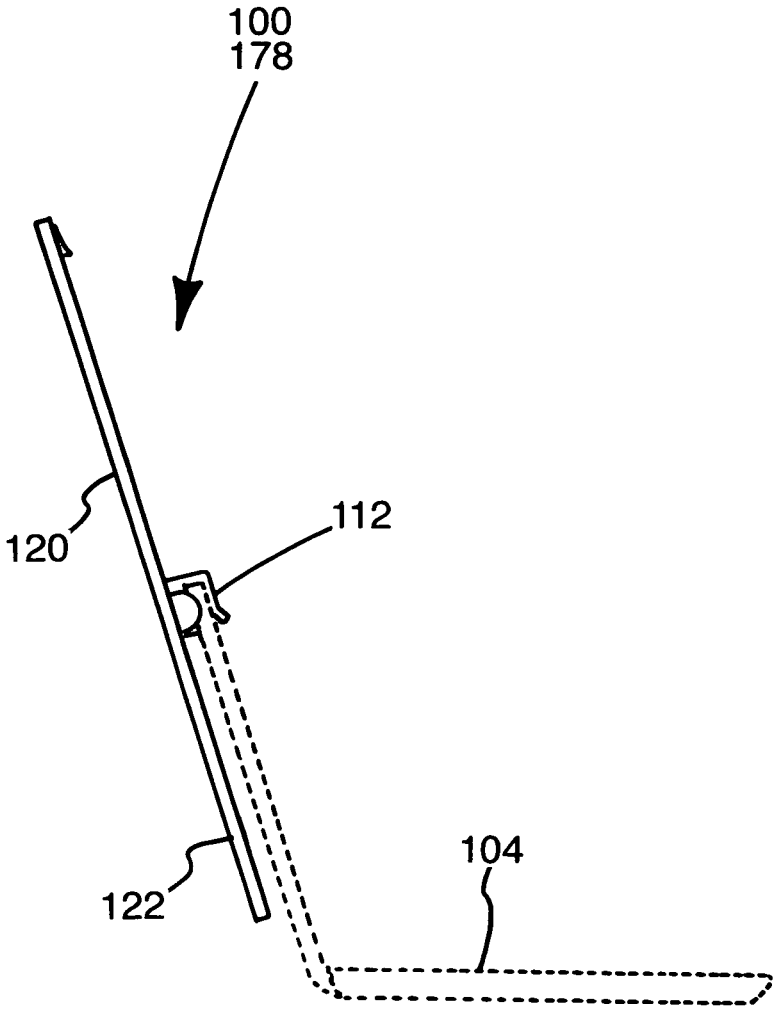
FIG. 3 depicts a profile view 178 of document holder 100 which shows center channel 120 and center stabilizer end 122 which work in conjunction with mount clamp 112. Computer 104 is depicted in phantom.

Now adding FIG. 3 to the consideration, the structure, function, security, and stability of document holder 100 can be more clearly seen. In this figure, profile view 178 of document holder 100 is seen. Center channel 120 and center stabilizer end 122 rest against the back of computer 104. Center channel 120 and center stabilizer end 122 work in conjunction with mount clamp 112 to keep the document holder 100 secure and stable. Mount clamp 112 rests against the front of computer 104.

Figure 4:
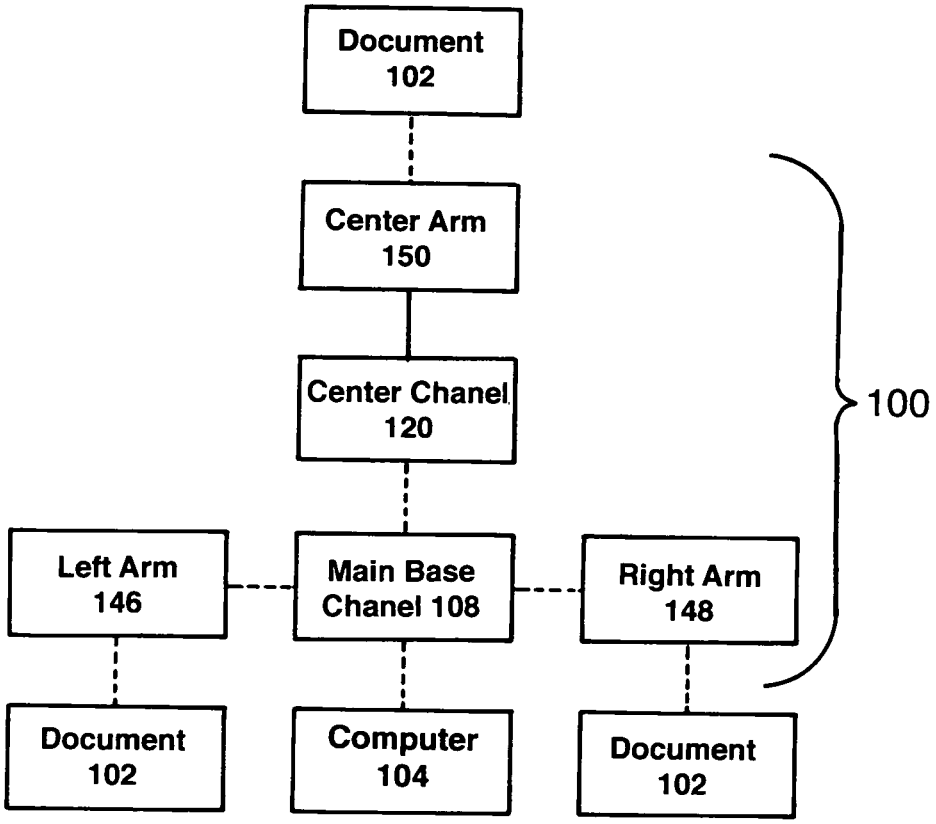
FIG. 4 depicts a block diagram of document holder 100 of this invention.

Now adding FIG. 4 to the consideration, the structure and function of document holder 100 is further depicted. Document holder 100 rests against computer 104. Document holder 100 has left arm 146, right arm 148, and center arm 150 to hold documents 102 in a flat plane and stable position. Main base channel 108 rests against the back of computer 104. Center channel 120 rests against the back of computer 104 to hold center arm 150 in place and add support and stability.

Figure 5:
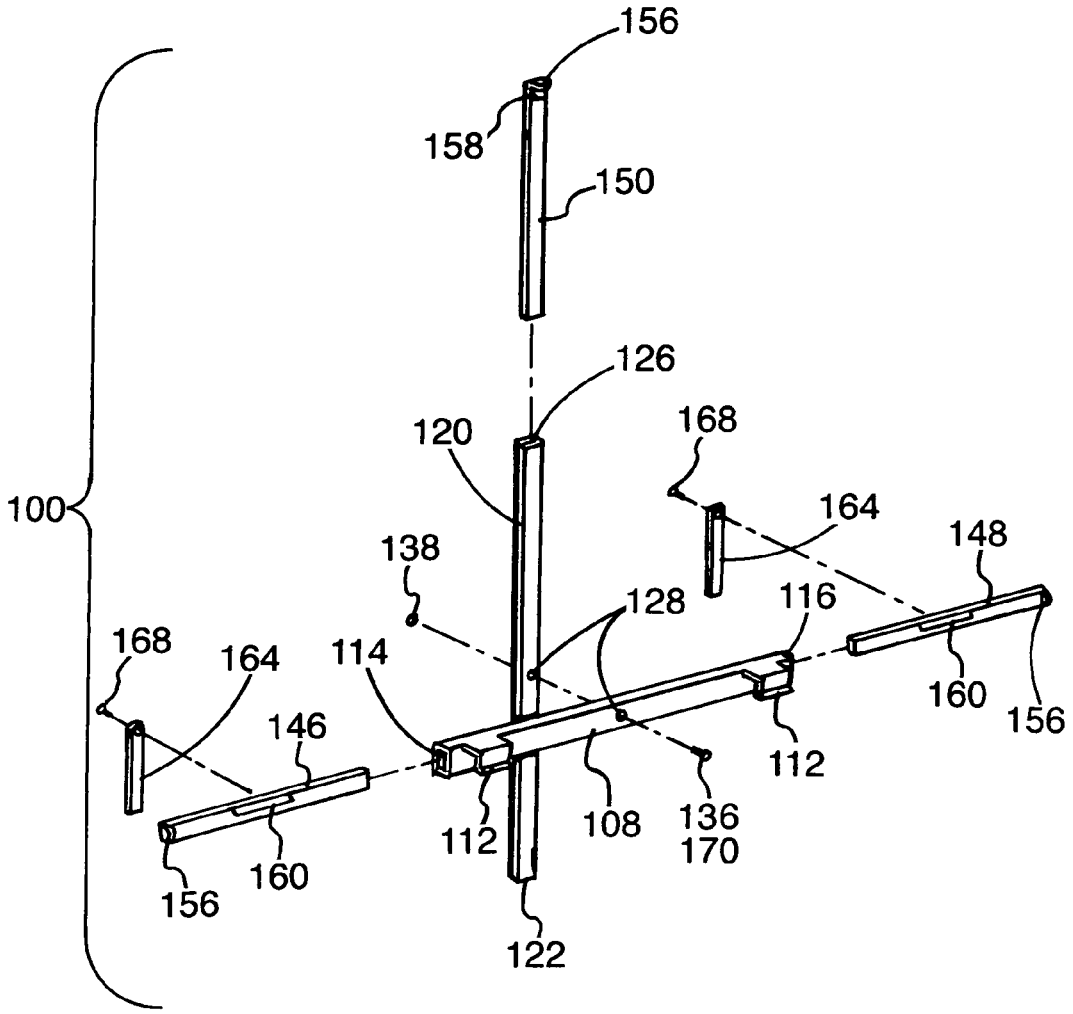
FIG. 5 depicts a front, perspective, exploded view of document holder 100.

Now adding FIG. 5 to the consideration, the structure of document holder 100 is more clearly depicted. Main base channel 108 rests against the back of computer 104. Left arm 146 and right arm 148 insert into main base channel 108 in a male to female relationship. Center channel 120 is connected to main base channel 108 through the cooperation of axle 170. Center arm 150 inserts into center channel 120 in a male to female relationship.

Axle 170 may be any suitable structure which can provide the pivotable movement between main base channel 108 and center channel 120. In the preferred embodiment, axle 170 is the axle pin 136 which cooperates with the fulcrum aperture 128 and the axle pin cap 138. However, axle 170 can be a nut and bolt assembly, a rivet, or any other secure and pivotable fastening means.

Main base channel 108 and center channel 120 have fulcrum aperture 128 to accept axle pin 136 and the connection is secured by axle pin cap 138. Main base channel 108 has mount clamp 112 on each opposing end. Mount clamp 112 secures document holder 100 to computer 104.

Main base channel 108 has right arm receiving slot 116 which allows right arm 148 to attach to main base channel 108 in a telescopic male to female relationship. Right arm 148 has arm aperture 130 which cooperates with snap axle pin 168 to attach sheet support 164 to right arm 148. Arm aperture 130 is a blind aperture and does not extend through to the front of right arm 148. Snap axle pin 168 and arm aperture 130 are the preferred fastening means. However, any fastening means which create a secure and movable relationship between sheet support 164 and right arm 148 such as but not limited to, a screw, a snap fastener, a spline, or any other bonding fastener, are acceptable embodiments.

Figure 10:
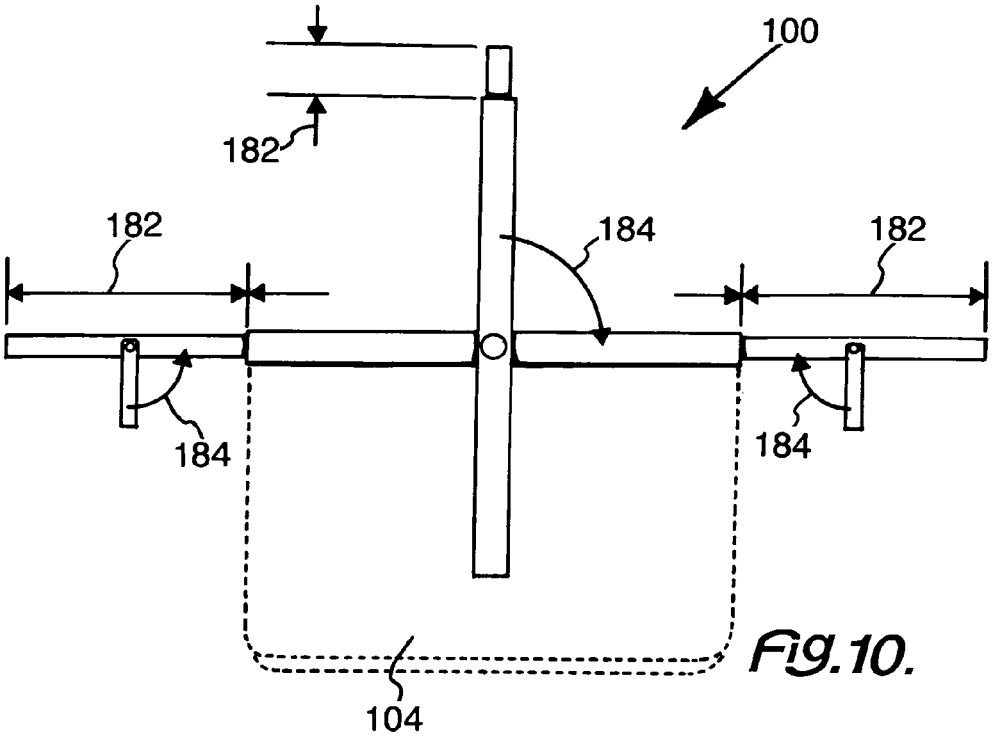
FIG. 10 depicts a rear view of document holder 100 featuring the extend or close swing travel 184 and open and close travel 182 with computer 104 depicted in phantom.

Document 102 inserts into grip bar 160 to further create a secure and stable flat plane position for document 102. Right arm 148 has pull tab 156 to provide a grip to aide in open and close travel 182 (FIG. 10).

Main base channel 108 also has left arm receiving slot 114 to allow left arm 146 to insert into main base channel 108 in a telescopic male to female relationship. Left arm 146 has an arm aperture 130 which cooperates with snap axle pin 168 to connect left arm 146 to sheet support 164. Left arm 146 has grip bar 160. Arm aperture 130 is a blind aperture and does not extend through to the front of left arm 146. Snap axle pin 168 and arm aperture 130 are the preferred fastening means. However, any fastening means which create a secure and movable relationship between sheet support 164 and left arm 146 such as but not limited to, a screw, a snap fastener, a spline, or any other bonding fastener, are acceptable embodiments.

Document 102 inserts into grip bar 160 to further create a secure and stable flat plane position for document 102. Left arm 146 has pull tab 156 to provide a grip to aid in open and close travel 182 (FIG. 10).

Center channel 120 accepts center arm 150 in a telescopic male to female relationship to allow it to rest against computer 104. Center channel 120 has center arm receiving slot 126 to aide in this telescopic male to female attachment. Center arm 150 has pull tab 156 to provide a grip to aide in open and close travel 182 (FIG. 10). Center arm 150 also has grip tab 158. Document 102 inserts into grip tab 158 to further create a secure and stable flat plane position for document 102. Center stabilizer end 122 rests against the back of computer 104. Center stabilizer end 122 allows center arm 150 to be securely attached to computer 104.

Figure 6:
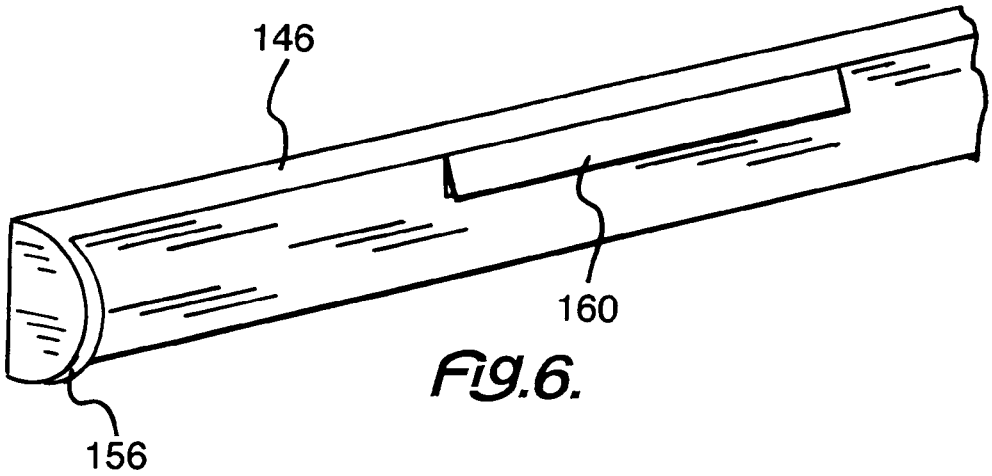
FIG. 6 depicts front perspective view of left arm 146 featuring grip bar 160 and pull tab 156.
Figure 7:
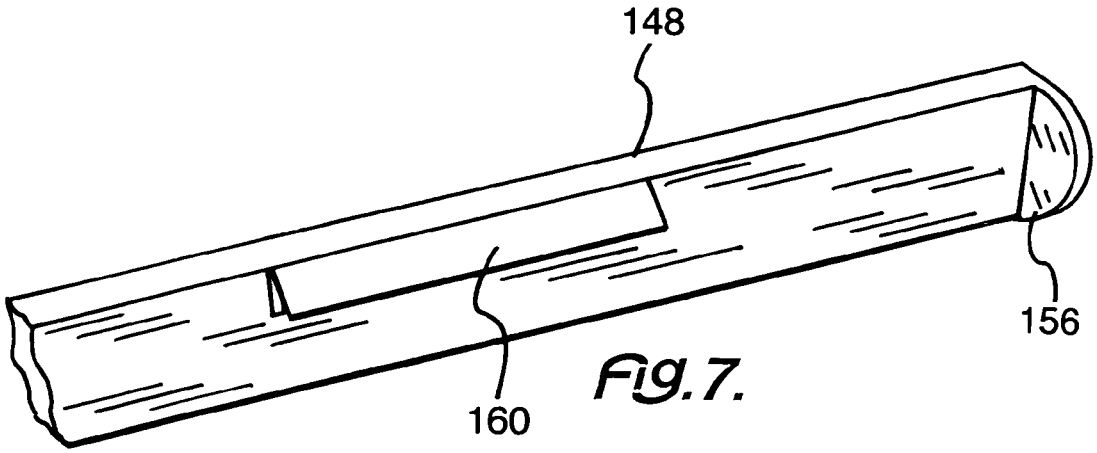
FIG. 7 depicts a front perspective view of right arm 148 featuring grip bar 160 and pull tab 156.
Figure 8:
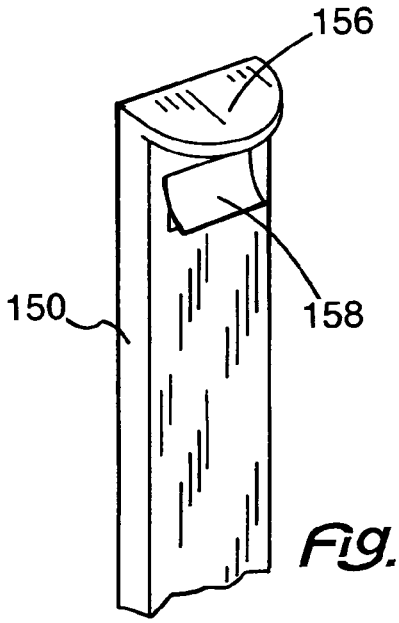
FIG. 8 depicts a front perspective view of center arm 150 featuring grip tab 158 and pull tab 156.

Now adding FIG. 6, FIG. 7, and FIG. 8 to the consideration, the structure and function of pull tab 156, grip tab 158, and grip bar 160 can be clearly seen. FIG. 6 depicts the pull tab 156 and grip bar 160 on left arm 146. FIG. 7 depicts the pull tab 156 and grip bar 160 on right arm 148. FIG. 8 depicts the pull tab 156 and grip tab 158 on center arm 150.

Grip tab 158 and grip bars 160 are molded, welded, fastened, or use any other suitable securing method to arms 146, 148, and 150. Between grip tab 158 and grip bars 160 and arms 146, 148, and 150 is a space to accept document 102. Grip tab 158 and grip bars 160 have a natural spring action to allow it to be lifted outward to accept documents 102 and then snapped back into place to secure documents 102 in a secure and stable position. Grip tab 158 and grip bars 160 have the resilience to snap back into position after they are lifted outward to accept documents 102.

Arms 146, 148, and 150 have pull tabs 156. Pull tabs 156 provide a grip to aid document holder 100 in open and close travel 182 (FIG. 10). Pull tabs 156 ease the open and close travel 182 of document holder 100.

Figure 9:
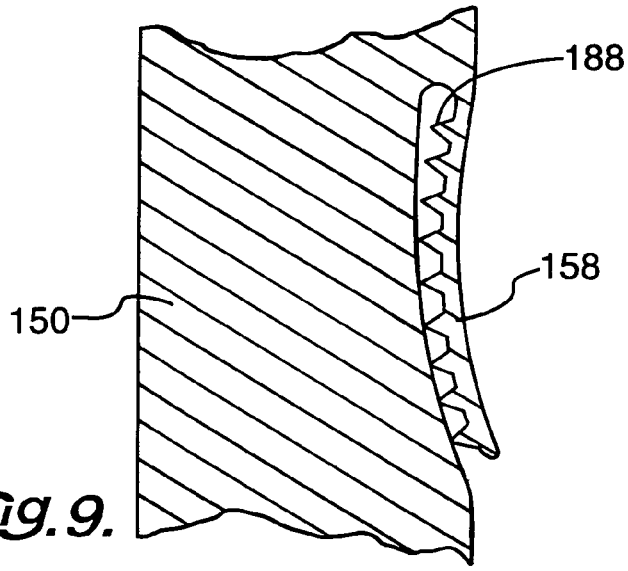
FIG. 9 depicts a cross section view of grip tab 158.

Now adding FIG. 9 to the consideration, the cross section view allows the structure and function of grip tab 158 to be clearly seen. The cross section view of grip bar 160 is substantially similar to grip tab 158. Center arm 150 has at least one grip tab 158 to secure document 102 to document holder 100. Document 102 inserts between grip tab 158 and center arm 150. Document 102 slides into grip tab 158 which allows it to provide a space to accept document 102. Once document 102 is inserted, grip tab 158 has the natural resilient springing action to snap back into place against center arm 150 to secure document 102 in a stable flat plane. Furthermore, grip tab 158 has teeth 188 to further secure the attachment between document 102 and center arm 150. Teeth 188 push against document 102 which forces document 102 to be further pushed against center arm 150. Teeth 188 are the preferred embodiment but ridges or any other suitable securing mechanism can be utilized and are covered in this description.

Now adding FIG. 10 to the consideration, the open and close travel 182 can be clearly seen. Document holder 100 is attached to computer 104. FIG. 10 is a rear view of document holder 100. Right arm 148 has the capability of open and close travel 182. When document holder 100 is in use, right arm 148 is extended outward from main base channel 108 through open and close travel 182. When document holder 100 is not in use, right arm 148 is pushed into main base channel 108 and closed inward through open and close travel 182 which allows it to be compactly stored and not interfere with use. The open and close travel 182 for right arm 148 is horizontal in motion.

Left arm 146 has the capability of open and close travel 182. When document holder 100 is in use, left arm 146 is extended outward from main base channel 108 through open and close travel 182. When document holder 100 is not in use, left arm 146 is pushed and closed into main base channel 108 through open and close travel 182. The open and close travel 182 allows document holder 100 to be compactly stored and not interfere with the use of computer 104. The open and close travel 182 for left arm 146 is horizontal in motion.

Sheet supports 164 move inward and align with either left arm 146 or right arm 148 through extend and close swing travel 184. Sheet supports 164 move upward when not in use so they insert into main base channel 108 with left arm 146 and right arm 148. Thus, sheet supports 164 do not interfere with use of computer 104 when document holder 100 is not in use. Sheet supports 164 move downward when document holder 100 is in use to support document 102.

Center arm 150 has the capability of open and close travel 182. When document holder 100 is in use, center arm 150 is extended upward and out of center channel 120 through open and close travel 182. Center channel 120 is extended upward from main base channel 108. Center channel 120 is substantially perpendicular to main base channel 108 when in full extension 186. When document holder 100 is not in use, center arm 150 is pushed into center channel 120 and closed downward through open and close travel 182. Center channel 120 swings downward and aligns with main base channel 108 through extend and close swing travel 184. Center channel 120 is substantially parallel to main base channel 108 when aligned for stored position (See FIG. 11). Extend and close swing travel 184 allows document holder 100 to be compactly stored and not interfere with the use of computer 104 when document holder 100 is not in use. The open and close travel 182 for center arm 150 is vertical in motion.

Figure 11:
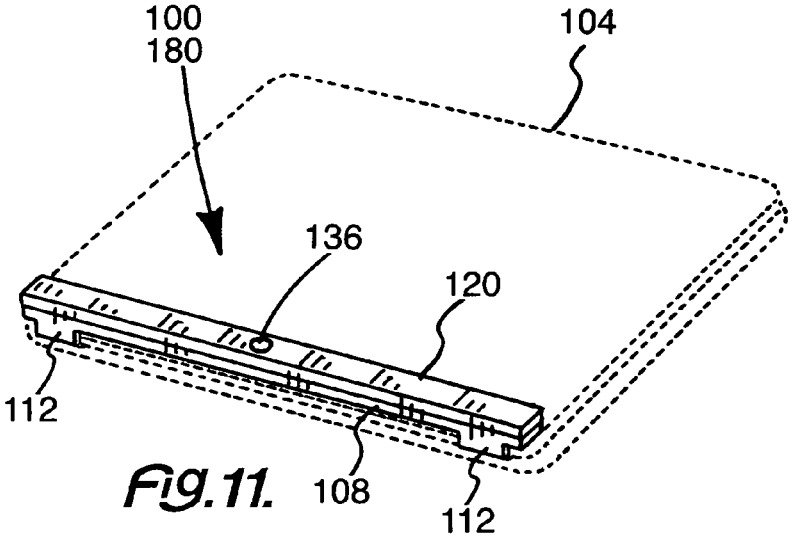
FIG. 11 depicts a rear perspective view of stored position 180 of document holder 100 of this invention with computer 104 depicted in phantom.

Now adding FIG. 11 to the consideration, the stored position 180 of document holder 100 can be clearly seen. When document holder 100 is not in use but computer 104 is in use, document holder 100 compactly folds together as not to interfere with the use of computer 104. Arms 146 and 148 use open and close travel 182 to push inward for stored position 180. Arms 146 and 148 use open and close travel 182 and move horizontal into main base channel 108. Center arm 150 uses open and close travel 182 to insert into center channel 120. Center channel 120 uses extend and close swing travel 184 to turn to a parallel position to main base channel 108. The cooperation of axle pin 136, fulcrum aperture 128, and axle pin cap 138 allows center channel 120 and center arm 150 to rotate 360 degrees on its axle pin cap 138, fulcrum aperture 128, and axle pin 136. Main base channel 108 always remains in a constant position. Mount clamps 112 are designed to cause the least interference with the use of computer 104 when document holder 100 is not in use.

Figure 12:
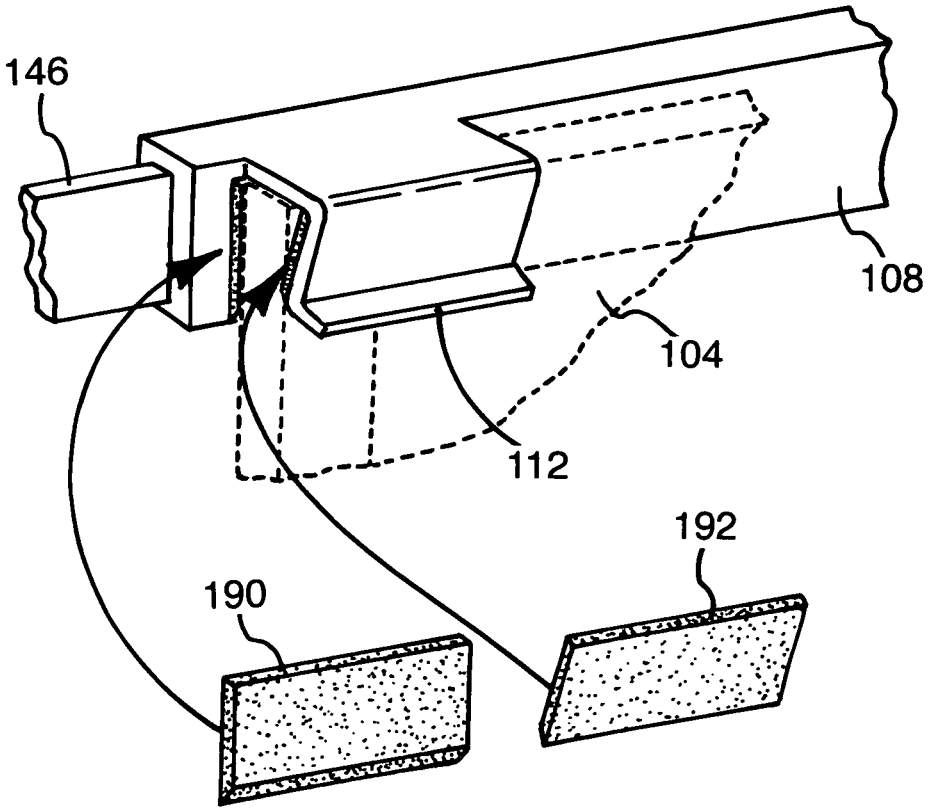
FIG. 12 depicts a front perspective view of mount clamp 112 attaching document holder 100 to computer 104 which is depicted in phantom.

Now adding FIG. 12 to the consideration, the structure of mount clamp 112 can be easily seen. Mount clamp 112 extends from main base channel 108 and extends over the top and down the front of computer 104. Mount clamp 112 is secured to computer 104 through tension. Mount clamp 112 has an outward angle at the end to allow easy removal of document holder 100 from computer 104.

Main base channel 108 has rear rubber pad 190 and mount clamp 112 has front rubber pad 192. Rubber pads 190 and 192 add a cushioning support such that document holder 100 does not damage computer 104 during the attachment and removal process. While the preferred material for pads 190 and 192 is rubber any suitable padding material such as plastic or foam is encompassed by this disclosure.

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this tool can become clear to a person having ordinary skill in this particular art. Such modifications are clearly covered by this disclosure.

What is claimed and sought to be protected by Letters Patent is:

1. A document holder which attaches to a computer and allows visual access to at least one document comprising:

the document holder having a fully extended position and a stored position;

the document holder having at least one arm to hold the at least one document;

the document holder being connectable to the computer;

the at least one arm being a right arm, a left arm, and a center arm;

the left arm and the right arm being substantially similar;

the document holder having a main base channel;

the document holder having a center channel;

the right arm and the left arm each having at least one sheet support connected through an attaching means;

the right arm and the left arm being connected to the main base channel;

the center arm being connected to the center channel;

a mount clamp extending from oppositely disposed ends of the main base channel;

the main base channel and the center channel attaching to each other in a movable relationship;

the at least one sheet support aiding in keeping the at least one document in a stable position;

the right arm and the left arm extending out of or into the main base channel in a male to female relationship;

the center arm extending out of or into the center channel in a male to female relationship;

an axle providing the movable relationship between the main base channel and the center channel;

the mount clamp extending over the top and down the front of the computer to attach the document holder to the computer;

the mount clamp resting against the front of the computer;

the center channel adding support to the center arm;

the center channel having a center stabilizer end and the center stabilizer end supporting the document holder against the computer;

the main base channel having a right arm receiving slot to receive the right arm;

the main base channel having a left arm receiving slot to receive the left arm;

the center channel having a center arm receiving slot to receive the center arm;

the left arm and the right arm each having a grip bar to further secure the at least one document to the document holder;

the center arm having a grip tab to further secure the at least one document to the document holder;

the mount clamp attaching the document holder to the computer through compression exerted on the computer by the mount clamp;

the right arm having an open and close travel capability to extend from or insert into the main base channel;

the left arm having the open and close travel capability to extend from or insert into the main base channel;

the center arm having the open and close travel capability to extend from or insert into the center channel;

the at least one sheet support having an extend and close swing travel capability to align with the left arm or the right arm and insert into the main base channel for the stored position;

the at least one sheet support having the extend and close swing travel capability to swing down from the left arm or the right arm to support the at least one document;

the center channel having the extend and close swing travel capability to swing up to a substantially perpendicular position to the main base channel for the full extension position; and the center channel having the extend and close swing travel capability to align with the main base channel in a parallel arrangement for the stored position.

2. The document holder of claim 1 further comprising:

a) the axle being an axle pin cooperating with a fulcrum aperture and an axle pin cap to create the movable relationship between the center arm and the main base channel;

b) the right arm having an arm aperture which cooperates with a snap axle pin as the attaching means for the at least one sheet support;

c) the left arm having the arm aperture which cooperates with the snap axle pin as the attaching means for the at least one sheet support;

d) the grip tab or the grip bar having a space between it and the center arm, the left arm, or the right arm to accept the at least one document; and e) the grip tab and the grip bar having a resilience to return to position once the at least one document is positioned.

3. The document holder of claim 2 further comprising:

a) the right arm, the left arm, and the center arm each having a pull tab to aid in the open and close travel;

b) the grip tab or the grip bar being molded or welded to the right arm, the left arm, or the center arm;

c) the grip tab and the grip bar having at least two teeth to further press the at least one document against the center arm, the left arm, or the right arm;

d) the main base channel having a rear rubber pad;

e) the mount clamp having a front rubber pad;

f) the front rubber pad and the rear rubber pad protecting the computer from compression exerted against the computer by the mount clamp; and g) the mount clamp having an outward angle at an end to aid in attaching and removing the document holder from the computer.

4. A method for attaching at least one document to a computer comprising:

mounting a document holder to the computer;

attaching the at least one document to the document holder;

providing the document holder with a fully extended position and a stored position;

providing the document holder with at least one arm to hold the at least one document;

connecting the at least one arm to the computer through the document holder;

providing the at least one arm as being a right arm, a left arm, and a center arm;

making the left arm and the right arm substantially similar;

providing the document holder with a main base channel;

providing the document holder with a center channel;

providing each the right arm and the left arm with at least one sheet support which is attached through an attaching means;

connecting the right arm and the left arm to the main base channel;

connecting the center arm to the center channel;

extending a mount clamp from oppositely disposed ends of the main base channel;

attaching the main base channel to the center channel in a movable relationship;

resting the main base channel and the center channel against the back of the computer;

providing the at least one sheet support as being capable of aiding in keeping the at least one document in a stable position;

extending the right arm and the left arm out of or into the main base channel in a male to female relationship;

extending the center arm out of or into the center channel in a male to female relationship;

creating the movable relationship between the main base channel and the center channel with an axle;

extending the mount clamp over the top and down the front of the computer to attach the document holder to the computer;

resting the mount clamp against the front of the computer;

supporting the center arm with the center channel;

supporting the document holder against the computer with the center channel and a center stabilizer end;

providing the main base channel with a right arm receiving slot to receive the right arm;

providing the main base channel with a left arm receiving slot to receive the left arm;

providing the center channel with a center arm receiving slot to receive the center arm;

providing each the left arm and the right arm with a grip bar to further secure the at least one document to the document holder;

providing the center arm with a grip tab to further secure the at least one document to the document holder;

attaching the document holder to the computer using compression exerted against the computer by the mount clamp;

extending the right arm from or inserting it into the main base channel with an open and close travel;

extending the left arm from or inserting it into the main base channel with the open and close travel;

extending the center arm from or inserting it into the center channel with the open and close travel;

aligning the at least one sheet support with the left arm or the right arm using an extend and close swing travel to insert the at least one sheet support and the left arm or the right arm into the main base channel for the stored position;

swinging the at least one sheet support down from the left arm or the right arm using the extend and close swing travel to support the at least one document;

parallelly aligning the center channel with the main base channel using the extend and close swing travel to achieve the stored position; and swinging the center channel up to a substantially perpendicular position to the main base channel using the extend and close swing travel to achieve the full extension position.

5. The method of claim 4 further comprising:

a) using an axle pin cooperating with a fulcrum aperture and an axle pin cap as the axle creating the movable relationship between the main base channel and the center channel;

b) providing the right arm with an arm aperture cooperating with a snap axle pin to serve as the attaching means for the at least one sheet support;

c) providing the left arm with the arm aperture cooperating with the snap axle pin to serve as the attaching means for the at least one sheet support;

d) providing a space between the grip tab or the grip bar and the center arm, the left arm, or the right arm to accept the at least one document; and e) providing the grip tab and the grip bar with a resilience to return to position once the at least one document is positioned.

6. The method of claim 5 further comprising:

a) providing the right arm, the left arm, and the center arm each with a pull tab to aid in the open and close travel;

b) molding or welding the grip tab or the grip bar to the right arm, the left arm, or the center arm;

c) providing the grip tab and the grip bar with at least two teeth to further press the at least one document against the center arm, the left arm, or the right arm;

d) providing the main base channel with a rear rubber pad;

e) providing the mount clamp with a front rubber pad;

f) protecting the computer from compression exerted against the computer by the mount clamp with the front rubber pad and the rear rubber pad; and g) providing the mount clamp with an outward angle at an end to aid in attaching and removing the document holder from the computer.

7. On a computer suitable for use as a word processor, the improvement comprising:

a document holder being mountable on the computer;

the document holder assisting in providing visual access to the at least one document;

the document holder being adapted to support the at least one document;

the document holder having a fully extended position and a stored position;

the document holder having at least one arm to receive the at least one document;

the at least one arm being connected to the computer through the document holder;

the at least one arm being a right arm, a left arm, and a center arm;

the left arm and the right arm being substantially similar;

the document holder having a main base channel;

the document holder having a center channel;

the right arm and the left arm each having at least one sheet support connected through an attaching means;

the right arm and the left arm being connected to the main base channel;

the center arm being connected to the center channel;

a mount clamp extending from oppositely disposed ends of the main base channel;

an axle connecting the main base channel and the center channel in a movable relationship;

the main base channel and the center channel resting against the back of the computer;

the at least one sheet support aiding in keeping the at least one document in a stable position;

the right arm and the left arm extending out of or into the main base channel in a male to female relationship;

the center arm extending out of or into the center channel in a male to female relationship;

the mount clamp extending over the top and down the front of the computer to attach the document holder to the computer;

the mount clamp resting against the front of the computer;

the center channel adding support to the center arm;

the center channel having a center stabilizer end and the center stabilizer end supporting the document holder against the computer;

the main base channel having a right arm receiving slot to receive the right arm;

the main base channel having a left arm receiving slot to receive the left arm;

the center channel having a center arm receiving slot to receive the center arm;

the left arm and the right arm each having a grip bar to further secure the at least one document to the document holder;

the center arm having a grip tab to further secure the at least one document to the document holder;

the mount clamp attaching the document holder to the computer through compression exerted against the computer by the mount clamp;

the right arm having an open and close travel capability to extend from or insert into the main base channel;

the left arm having the open and close travel capability to extend from or insert into the main base channel;

the center arm having the open and close travel capability to extend from or insert into the center channel;

the at least one sheet support using an extend and close swing travel capability to align with the left arm or the right arm and insert into the main base channel for the stored position;

the at least one sheet support using the extend and close swing travel capability to swing down from the left arm or the right arm to support the at least one document;

the center channel having the extend and close swing travel capability to swing up to a substantially perpendicular position to the main base channel;

the center channel having the extend and close swing travel capability to align with the main base channel in a substantially parallel arrangement for the stored position;

the axle being an axle pin cooperating with a fulcrum aperture and an axle pin cap;

the right arm having an arm aperture cooperating with a snap axle pin to serve as the attaching means for the at least one sheet support;

the left arm having the arm aperture cooperating with the snap axle pin to serve as the attaching means for the at least one sheet support;

the grip tab or the grip bar having a space between it and the center arm, the left arm, or the right arm to accept the at least one document;

the grip tab and the grip bar having a resilience to return to position once the at least one document is positioned;

the right arm, the left arm, and the center arm each having a pull tab to aid in the open and close travel;

the grip tab or the grip bar being molded or welded to the right arm, the left arm, or the center arm;

the grip tab and the grip bar having at least two teeth to further press the at least one document against the center arm, the left arm, or the right arm;

the main base channel having a rear rubber pad;

the mount clamp having a front rubber pad;

the front rubber pad and the rear rubber pad protecting the computer from compression exerted against the computer by the mount clamp;

the mount clamp having an outward angle at an end to aid in attaching and removing the document holder from the computer; and the computer being a laptop computer or a desktop computer.

* * * * *